US010329120B2

(12) United States Patent
Dube

(10) Patent No.: US 10,329,120 B2
(45) Date of Patent: Jun. 25, 2019

(54) ELEVATOR OVERSPEED GOVERNOR

(71) Applicant: Otis Elevator Company, Farmington, CT (US)

(72) Inventor: Randall S. Dube, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 320 days.

(21) Appl. No.: 15/262,382

(22) Filed: Sep. 12, 2016

(65) Prior Publication Data

US 2017/0073189 A1 Mar. 16, 2017

Related U.S. Application Data

(60) Provisional application No. 62/217,837, filed on Sep. 12, 2015.

(51) Int. Cl.

| | |
|---|---|
| ***B66B 5/04*** | (2006.01) |
| ***B66B 5/18*** | (2006.01) |
| ***B66B 9/00*** | (2006.01) |
| ***B66B 11/00*** | (2006.01) |

(52) U.S. Cl.

CPC ..... *B66B 5/044* (2013.01); *B66B 5/18* (2013.01); *B66B 9/00* (2013.01); *B66B 11/004* (2013.01)

(58) Field of Classification Search

CPC ..... B66B 5/044; B66B 5/046

See application file for complete search history.

(56) References Cited

U.S. PATENT DOCUMENTS

| | | | | |
|---|---|---|---|---|
| 1,549,736 | A * | 8/1925 | McCormick | B66B 5/044 187/287 |
| 3,327,811 | A * | 6/1967 | Mastroberte | B66B 5/044 187/305 |
| 3,718,214 | A | 2/1973 | Newman | |
| 3,945,478 | A | 3/1976 | Kellerman et al. | |
| 4,016,964 | A | 4/1977 | Dietzsch et al. | |
| 4,821,859 | A | 4/1989 | Suchdev et al. | |
| 4,960,194 | A | 10/1990 | Sageshima et al. | |
| 5,052,523 | A | 10/1991 | Ericson | |
| 5,217,091 | A | 6/1993 | Shiina et al. | |
| 5,310,022 | A | 5/1994 | Sheridan et al. | |
| 5,387,157 | A | 2/1995 | Nameny | |
| 5,513,723 | A | 5/1996 | Luebke | |
| 6,736,249 | B2 | 5/2004 | Howell et al. | |
| 6,865,763 | B2 | 3/2005 | Sears | |
| 8,602,942 | B2 | 12/2013 | Long | |
| 9,050,661 | B1 | 6/2015 | Kosmowski | |

(Continued)

FOREIGN PATENT DOCUMENTS

| | | | |
|---|---|---|---|
| CN | 101565141 | A | 10/2009 |
| CN | 104350003 | A1 | 2/2015 |

(Continued)

OTHER PUBLICATIONS

Machine Translation of WO 2013/179336 Dec. 2013.*

(Continued)

*Primary Examiner* — Diem M Tran

(74) *Attorney, Agent, or Firm* — Bachman & LaPointe, P.C.

(57) ABSTRACT

An elevator governor rotor comprises a central axis and a plurality of pairs of lobes. Each pair of lobes comprises an inner lobe and an outer lobe.

23 Claims, 10 Drawing Sheets

(56) References Cited

U.S. PATENT DOCUMENTS

| | | | | |
|---|---|---|---|---|
| 9,464,479 | B1 * | 10/2016 | Kee | E05D 13/003 |
| 2001/0037920 | A1 | 11/2001 | Draper et al. | |
| 2004/0134726 | A1 | 7/2004 | Sanchez et al. | |
| 2010/0025646 | A1 | 2/2010 | Dube | |
| 2011/0272217 | A1 * | 11/2011 | Niikawa | B66B 5/044 187/305 |
| 2012/0103732 | A1 | 5/2012 | Kwon | |
| 2013/0306409 | A1 | 11/2013 | Dube | |
| 2015/0136544 | A1 | 5/2015 | Dube et al. | |

FOREIGN PATENT DOCUMENTS

| | | | | |
|---|---|---|---|---|
| DE | 102010054304 | A1 | 6/2011 | |
| EP | 0499379 | A2 | 8/1992 | |
| JP | 4932035 | A | 3/1974 | |
| KR | 20060081716 | A * | 7/2006 | B66B 5/044 |
| WO | 2010/048990 | A1 | 5/2010 | |
| WO | 2013179336 | A1 | 5/2013 | |

OTHER PUBLICATIONS

Machine Translation of KR 20060081716 Jul. 2006.*
Extended European Search Report dated May 26, 2017 for EP Patent Application No. 16275132.5.
Chinese Office Action dated Jun. 28, 2018 for Chinese Patent Application No. 201610819413.1.
Lubomir Janovsky, "Elevator Mechanical Design", 3rd edition, 1999, pp. 269-270, Elevator World, Inc., Mobile, Alabama.
European Search Report dated Feb. 6, 2017 for EP Patent Application No. 16275132.5.

* cited by examiner

ELEVATOR OVERSPEED GOVERNOR

CROSS-REFERENCE TO RELATED APPLICATION

Benefit is claimed of U.S. Patent Application No. 62/217,837, filed Sep. 12, 2015, and entitled "Elevator Overspeed Governor", the disclosure of which is incorporated by reference herein in its entirety as if set forth at length.

BACKGROUND

The disclosure relates to elevator overspeed governors. More particularly, the disclosure relates to lobed centrifugal governors.

A number of elevator governor configurations are in use. One common group of governor configurations is known as pendulum-type governors. An example of such a governor is found in Lubomir Janovsky, "Elevator Mechanical Design", 3rd edition, 1999, pages 269-270, Elevator World, Inc., Mobile, Ala.

Another type of governor is the flyweight-type governor. Examples have a governor rotor including a plurality of pivotally-mounted lobes. The circle swept by the lobes during rotation of the rotor increases with speed. At some threshold speed, the lobes may trigger a sensor (e.g., a switch) that may cut power to the elevator machine and/or trigger other safety functions. An example of this is found in Janovsky, above.

Such lobed governors have been proposed for use in a variety of mounting situations. These mounting situations include car-mounted situations wherein the governor sheave is engaged by a stationary or other tension member (e.g., rope, belt, or the like) so as to rotate the sheave and rotor during normal ascent and descent of the elevator. Other configurations involve stationary governors wherein the governor is mounted, for example, in the equipment room or hoistway and its sheave is driven by engagement with a tension member that moves with the car.

SUMMARY

One aspect of the disclosure involves an elevator governor rotor comprising a central axis and a plurality of pairs of lobes. Each pair of lobes comprises an inner lobe and an outer lobe.

In one or more embodiments of any of the foregoing embodiments, each inner lobe is between the central axis and the associated outer lobe.

In one or more embodiments of any of the foregoing embodiments, a single piece forms the plurality of pairs of lobes.

In one or more embodiments of any of the foregoing embodiments, each of the inner lobes and outer lobes comprises a distal protuberant portion and a generally circumferentially extending outboard flexing portion.

In one or more embodiments of any of the foregoing embodiments, in a zero-speed condition the inner lobes are nested between the protuberant portion and flexing portion of the associated outer lobe.

In one or more embodiments of any of the foregoing embodiments, the rotor further comprises axial projections projecting axially from the at least one of the inner lobes and the outer lobes.

In one or more embodiments of any of the foregoing embodiments, an elevator governor comprises: the rotor of any previous claim; a sheave mounted for rotation about the axis; and a sensor positioned to interface with the rotor in at least a portion of a speed range of the rotation.

In one or more embodiments of any of the foregoing embodiments, each of the inner lobes has an axial projection and each of the outer lobes has an axial projection. The governor further comprises an actuating ring positioned to be engaged by: said axial projections of the inner lobes in at least one condition of centrifugal radial displacement of said axial projections of the inner lobes; and said axial projections of the outer lobes in at least one condition of centrifugal radial displacement of said axial projections of the outer lobes.

In one or more embodiments of any of the foregoing embodiments, the sensor is positioned to engage the periphery at a threshold speed in at least a first condition. The governor further comprises: a restraining ring shiftable between a first position in the first condition and a second position in a second condition; and an actuator coupled to the restraining ring to shift the restraining ring.

In one or more embodiments of any of the foregoing embodiments, the governor further comprises a controller having programming to shift the restraining ring from the first condition to the second condition with a change in elevator direction.

In one or more embodiments of any of the foregoing embodiments, wherein: at a first rotational speed about the axis, movement of the outer lobes triggers the sensor; and at second rotational speed about the axis, greater than the first rotational speed, the axial projection of the outer lobes engage the actuating ring to, in turn, engage a mechanical safety.

In one or more embodiments of any of the foregoing embodiments, an elevator comprises the governor and further comprises: a car mounted in a hoistway for vertical movement; an elevator machine coupled to the car to vertically move the car within the hoistway; and a rope engaging the sheave to rotate the rotor as the car moves vertically.

In one or more embodiments of any of the foregoing embodiments, the sheave is mounted relative to the hoistway for said rotation about said axis.

In one or more embodiments of any of the foregoing embodiments, the elevator further comprises: a mechanical safety and a safety linkage for actuating the mechanical safety, the rope being coupled to the safety linkage; a governor rope gripping system having a ready condition disengaged from the rope and an engaged condition clamping the rope to impose a drag on the rope as the rope moves; an engagement mechanism positioned to be triggered by rotation of the rotor at a threshold speed to shift the governor rope gripping system from the ready condition to the engaged condition.

In one or more embodiments of any of the foregoing embodiments, the elevator machine has a brake electrically or electronically coupled to the sensor.

In one or more embodiments of any of the foregoing embodiments, the inner lobes are configured to be operative to govern elevator speed in a first direction of up and down and the outer lobes are configured to govern elevator speed in the other direction.

In one or more embodiments of any of the foregoing embodiments, a method for using the elevator comprises shifting the restraining ring in association with a change in direction of the elevator.

In one or more embodiments of any of the foregoing embodiments, the governor is configured to allow a higher car-upward speed than car-downward speed.

In one or more embodiments of any of the foregoing embodiments, the governor is configured to allow a maximum car-upward speed at least 20% higher than a maximum car-downward speed.

In one or more embodiments of any of the foregoing embodiments, a mechanical safety actuating action of the governor is configured to allow a maximum car-upward speed at least 20% higher than a maximum car-downward speed.

Another aspect of the disclosure involves an elevator governor jaw system comprising: a first jaw shiftable from a disengaged position to an engaged second position via a partially downward motion; a second jaw spring biased toward the first jaw when the first jaw is in the engaged position so as to clamp the rope between the first jaw and the second jaw; and means for restraining upward movement of the first jaw from the engaged position.

In one or more embodiments of any of the foregoing embodiments: the means comprises a restraining member shiftable from a retracted position to an extended position under bias of a spring; and a linkage is configured to hold the restraining member in its retracted condition until actuated by a dropping of the first jaw from the disengaged position to the engaged position so as to release the restraining member.

In one or more embodiments of any of the foregoing embodiments, a guide means is configured to guide the partially downward motion to bring the first jaw into contact with the rope.

In one or more embodiments of any of the foregoing embodiments, the guide means is configured to guide the partially downward motion to bring the first jaw into contact with the rope so as to, in turn, bring the rope into engagement with the second jaw.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
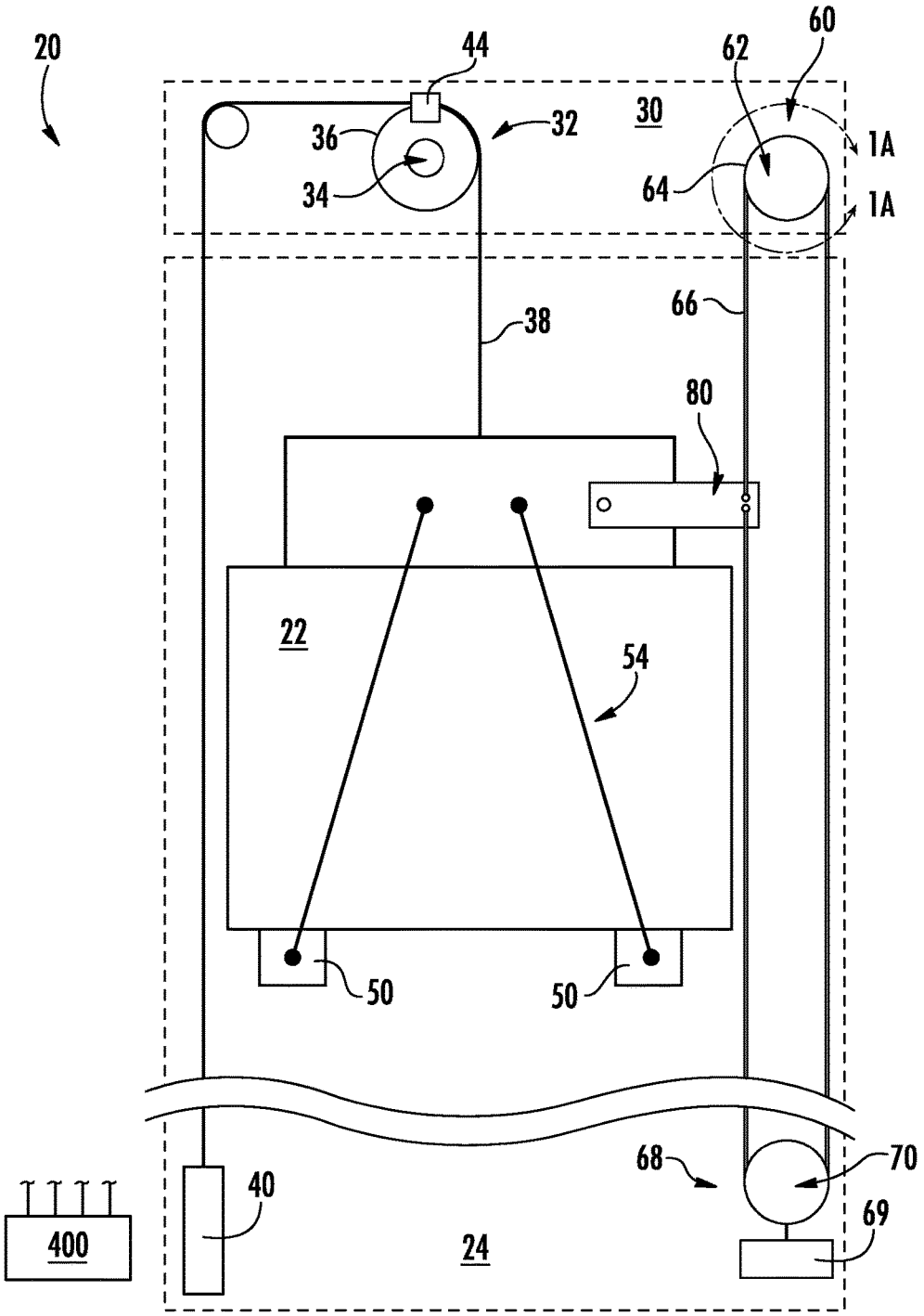
FIG. 1 is a partially schematic view of an elevator system in a building.

FIG. 1 shows an elevator system 20 including an elevator car 22 mounted in a hoistway 24 of a building. The exemplary elevator has a machine room 30 at the top of the hoistway containing an elevator machine (lift machine) 32 for raising and lowering the elevator. The elevator machine 32 may be any of a number of conventional or yet-developed configurations. The exemplary elevator machine includes an electric motor 34 driving a sheave 36 around which a belt, rope, or the like 38 is wrapped so as to suspend the elevator car. A counterweight (CWT) 40 may at least partially balance the car. Various complex roping configurations are known. However, a basic configuration is schematically shown. One safety feature on many elevator systems is a machine brake system (machine brake) 44 (e.g., a drum brake or a disk brake system with one or more disks on the machine rotor and one or more calipers per disk).

As a further safety feature, the elevator car includes safeties 50 which may be actuated to grip/clamp or otherwise engage features of the hoistway (e.g., guide rails) to decelerate and hold/brake the car. Exemplary safeties are shown at the bottom of the car; however other locations are possible. The safeties may be actuated by a safety linkage 54 as is known in the art. One actuating modality for the safeties is via an overspeed governor. FIG. 1 shows an elevator governor system 60 having a stationary governor 62 mounted in a machine room. The governor includes a sheave 64 around of which a rope 66 is wrapped and coupled to a tensioning device 68 (e.g., a mass 69 suspended from the rope 66 via a pulley 70). Alternative tensioning mechanisms may feature a spring instead of a hanging mass. The rope 66 may be secured to an actuator 80 for actuating the safety linkage 54. The exemplary safeties 50 are bi-directional safeties configured to decelerate and stop the car in both directions. Depending upon car configuration, etc., there may be multiple sets of such safeties operated in parallel. As is discussed further below, when the over speed governor is mechanically triggered it applies resistance to the rope. With car-upward movement, this resistance is transferred via the counterweight 40 as a downward force on the actuator 80. With car-downward movement, the resistance is transferred as an upward force. The exemplary actuator 80 may be configured to actuate the safeties responsive to both such forces. Alternative safeties may be unidirectional with separate safeties or groups provided for upward movement and downward movement, respectively. A variety of such unidirectional safeties and bi-directional safeties are known and may be appropriate for use with the governor as described below.

In normal operation, if the elevator moves up and down, the vertical movement of the elevator car pulls the rope 66 to, in turn, rotate the governor sheave. Due to inertia and friction, the actuator 80 must apply some tension to the governor rope to commence or maintain governor rotation. Similarly, the actuator may be required to apply some tension to stop governor rotation such as when the elevator car naturally stops. Such routine forces must not cause actuation of the safety linkage 54. Thus, the actuator 80 is capable of applying up to a threshold tension on the rope 66 without actuating the safety linkage 54. In normal operation, this threshold tension is above the tension associated with any drag of the governor system 60. The threshold tension may be achieved by providing springs (not shown) biasing the actuator 80 toward a neutral condition/position.

Thus, as the elevator moves up and down, the governor sheave 64 is rotated via tension in the rope 66. However, upon the governor sheave 64 rotating above a certain threshold rotational speed (thus associated with a threshold car vertical velocity) the governor 62 may cause an increase in the drag on the rope 66 to exceed the threshold of the actuator 80. At this point, the actuator 80 trips the safety linkage 54 to actuate the safeties. Exemplary safeties provide a controlled deceleration to a stop and hold the car in place. Details of an example of this purely mechanical actuation are discussed further below.

Additionally, the governor 62 may have an electric or electronic safety function. Upon exceeding a threshold speed (lower than the threshold speed associated with actuation of the mechanical safeties 50) the governor may provide an electric or electronic response such as initiating shutting off power to the motor 34. The governor may trigger a sensor or switch to, in turn, interrupt power. In one set of examples, this may involve a mechanical tripping of a mechanical switch that causes the controller and/or the motor drive to terminate power to the motor 34 and engage the machine brake 44.

As noted above, the governor 62 includes the sheave 64 (FIG. 2) which may be mounted for rotation about an associated axis 500 (e.g., via bearings). A lobed rotor 100 may be coaxially mounted with the sheave to rotate therewith. The exemplary rotor comprises a single piece (e.g., as if machined from metallic plate stock). The rotor has a first face 102 and a second face 104. The machining may provide a central aperture 106 ((FIG. 3), e.g., for passing one or more concentric shafts (not shown)) and mounting apertures 108 (e.g., for mounting to a mounting flange (not shown). The machining divides the rotor into a plurality of pairs of inner lobes 110 and associated outer lobes 112. A periphery 114 of the rotor is generally formed by peripheral portions of the outer lobes. Peripheral portions of the inner lobes are shown as 116 with gaps 118 between each inner lobe and the associated outer lobe. Thus, in the illustrated example, each inner lobe is nested radially between the associated outer lobe and the rotor axis 500. An exemplary pair count is two to six with three pairs being shown in the illustrated example.

Each of the lobes comprises a distal protuberant portion 120, 122 and a generally circumferentially extending outboard flexing portion 124, 126. In the zero-speed condition of FIG. 3, the inner lobes are nested between the protuberant portion and flexing portion of the associated outer lobe. As the rotor rotates with increasing speed, the portions 124 and 126 flex and the lobes begin to rotate outward about axes of rotation associated with the flexion. These axes may shift with the stage of flexion. Various portions of the lobes or features mounted to the lobes may cooperate with other features of the governor to provide the governing function. In some implementations, the periphery 114 may interact with other portions of the governor. In some implementations, radial projections may cooperate with other features. In some implementations, optical indicia, magnetic features, or the like, may cooperate with other aspects of the governor. The specific FIG. 3 example, however, shows axial projections 130, 131 mounted to each of the inner lobes and outer lobes respectively.

The exemplary projections 130, 131 are pins or sleeves secured to the rotor in non-rotating fashion. The non-rotating fashion combined with any friction treatment (e.g., knurling) provides a sufficient friction interface to transmit rotation to a ring 140 (discussed relative to FIG. 2 below). FIG. 3 also shows a rotation direction 510 associated with downward movement of the car and a rotation direction 512 associated with upward movement of the car. In various implementation, however, these may be reversed.

Figure 1A:
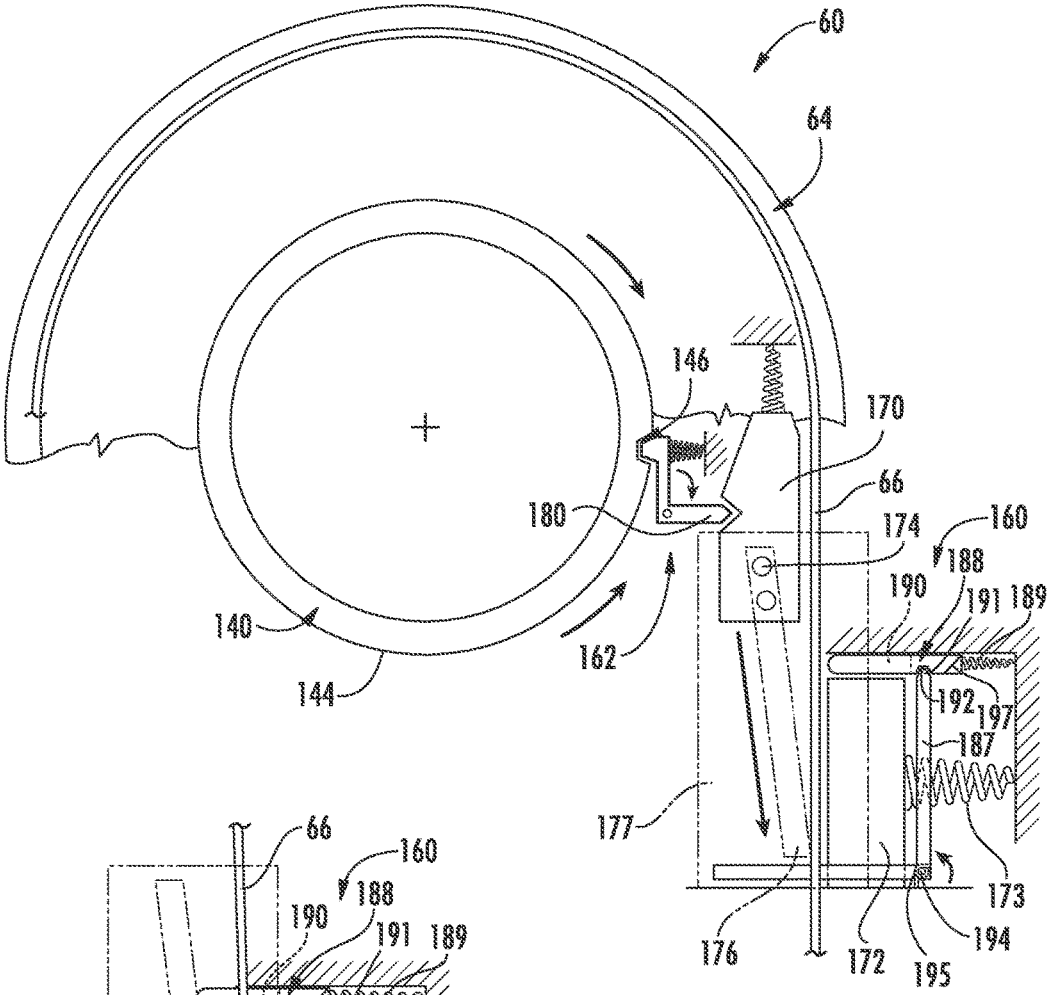
FIG. 1A is an enlarged view of a governor rope clamp of the elevator system generally at region 1A-1A of FIG. 1 showing a disengaged or ready condition.
Figure 2:
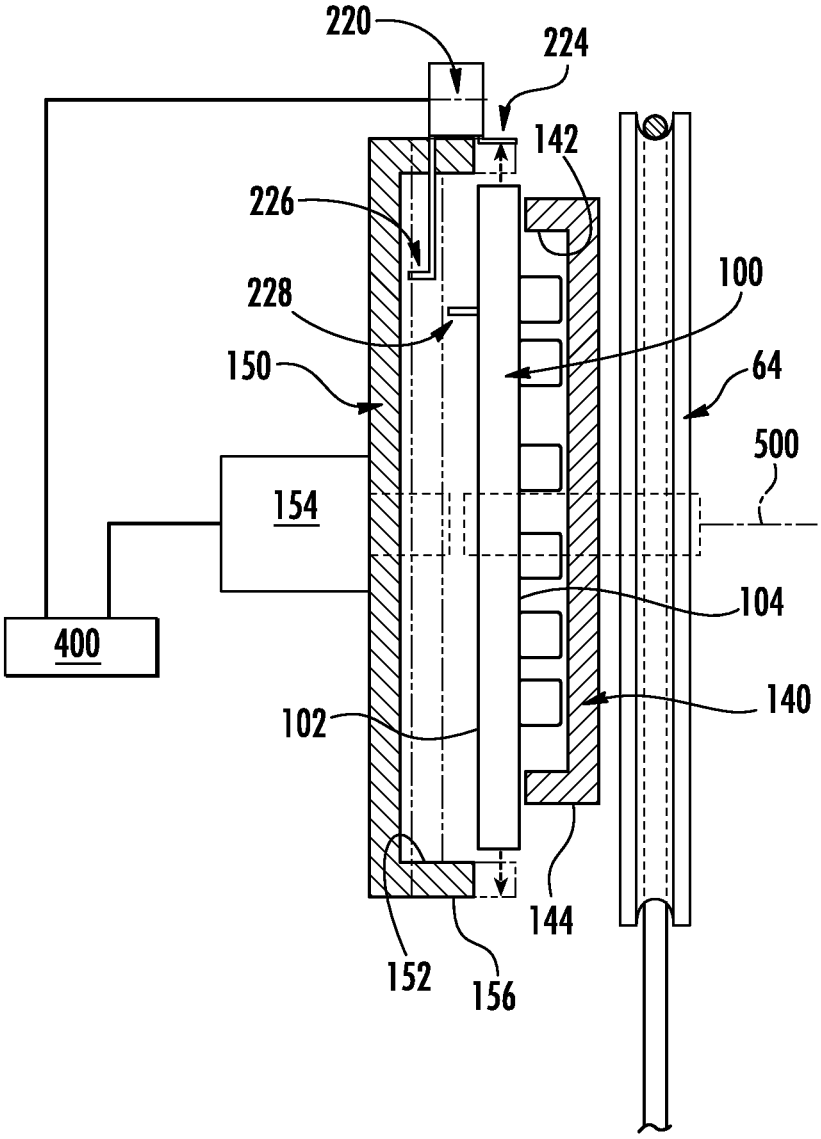
FIG. 2 is a side sectional view of the governor.
Figure 3:
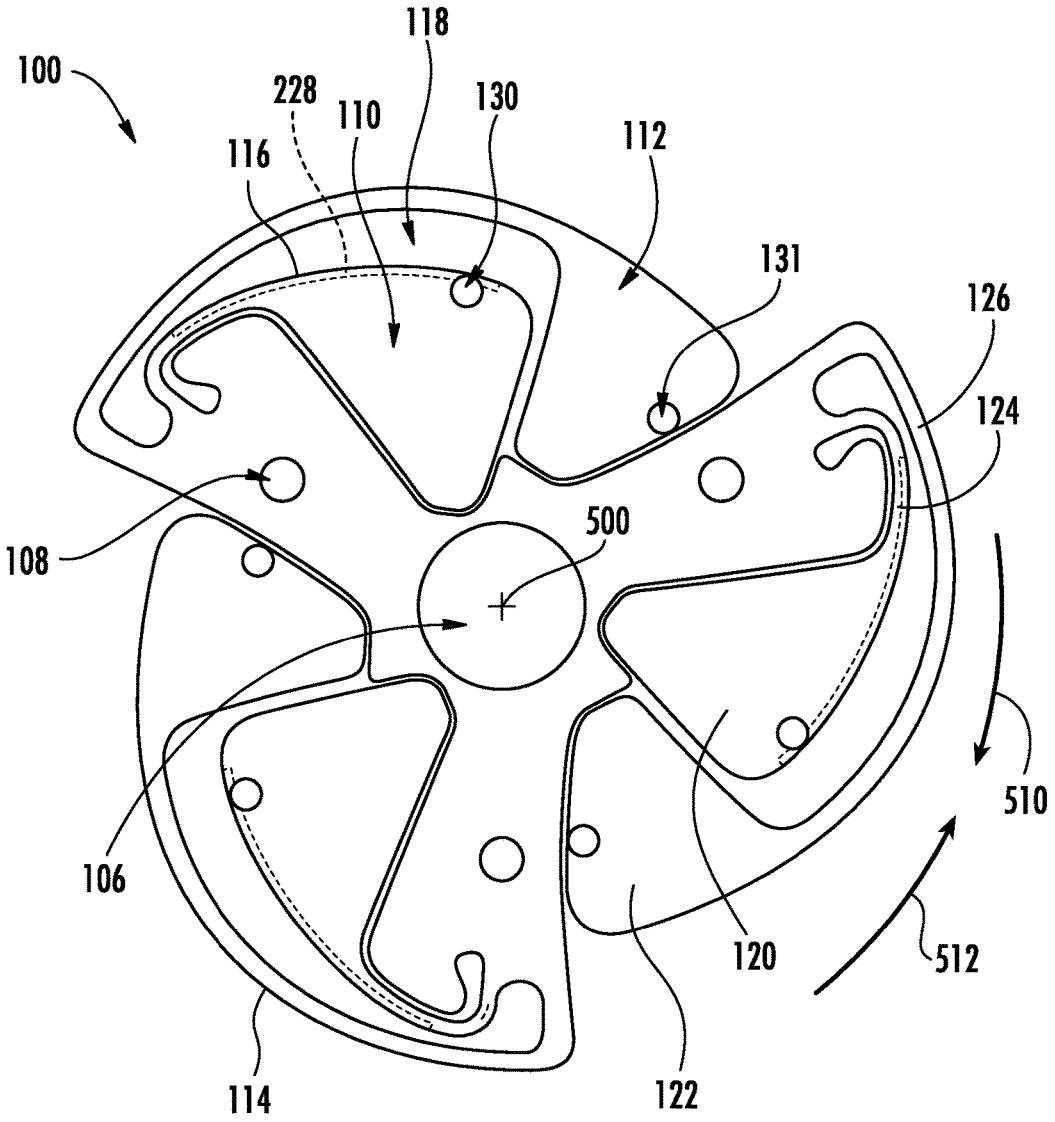
FIG. 3 is a view of a rotor of the governor.

FIG. 2 shows a ring 140 having an inner diameter (ID) surface 142 radially outboard of the features 130, 131. As rotor speed increases, the features will shift radially outward (the features 130 of the inner lobes shifting outward differently than the features 131 of the outer lobes). At some speed, the features of at least one of the sets of lobes will come into contact with the ID surface 142 whereupon friction will cause the normally stationary ring 140 to rotate about the axis 500. As is discussed further below, this may be used as part of a braking system 160 (FIG. 1A) for applying tension to the rope 66 for actuating the safeties 50.

Figure 4:
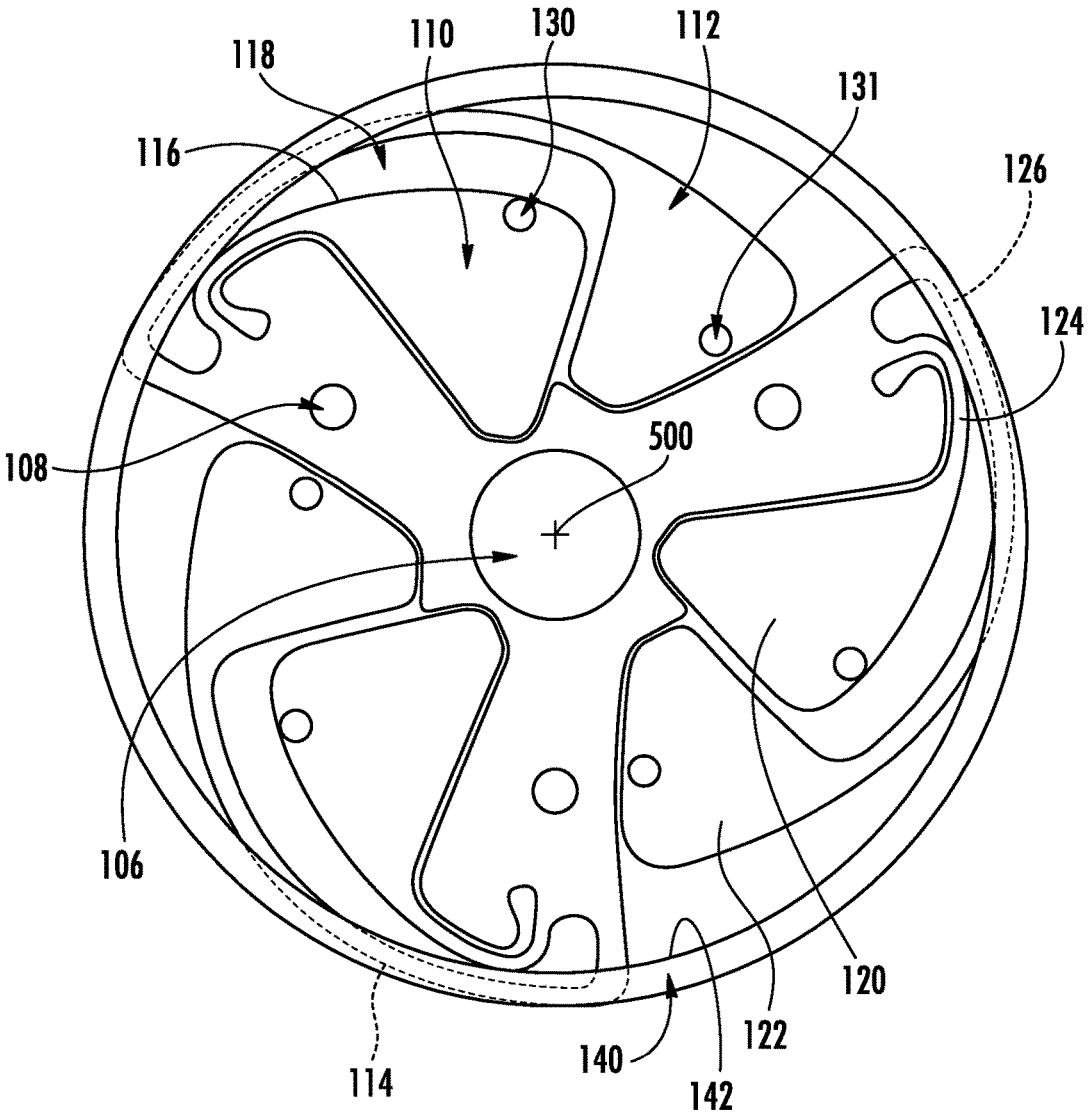
FIG. 4 is a partial view of the rotor showing lobe positions at zero speed.
Figure 5:
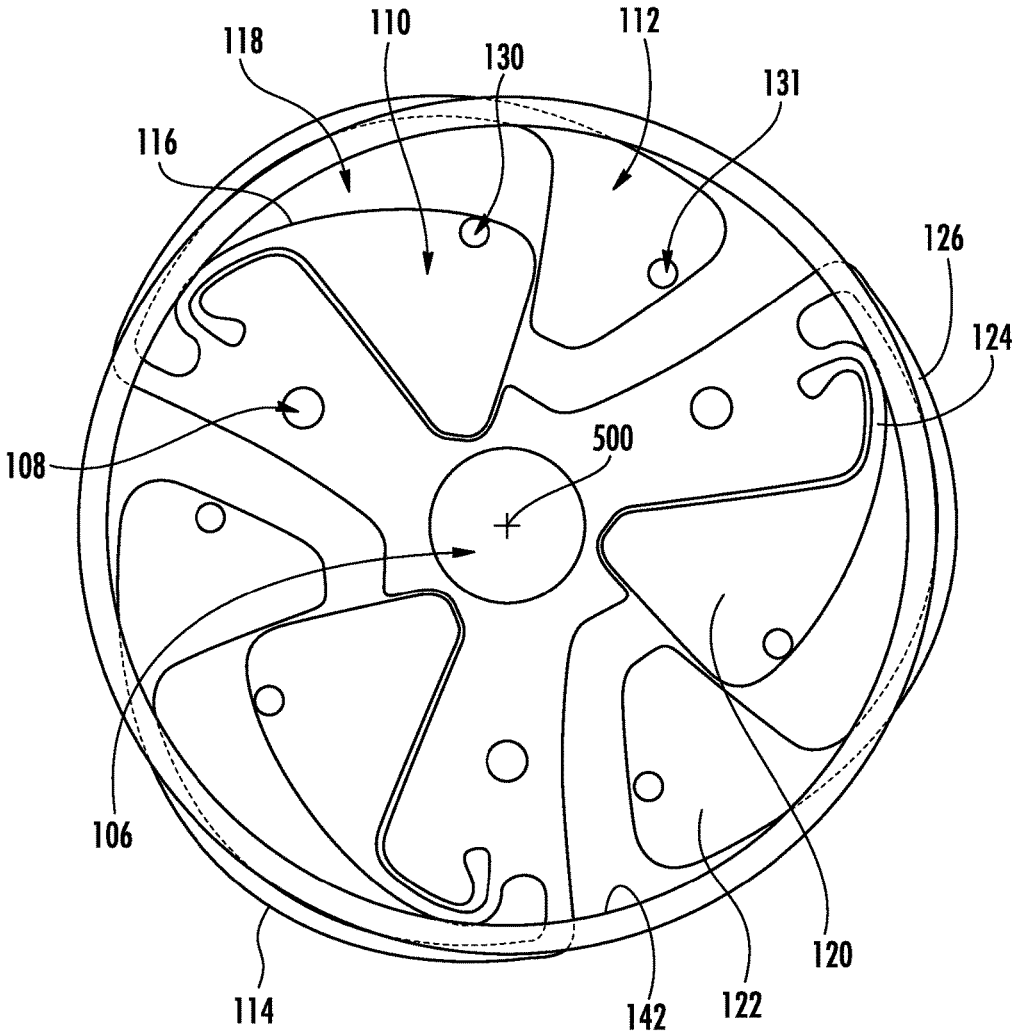
FIG. 5 is a partial view of the rotor showing lobe positions at a first car-downward speed.

FIG. 4 shows a zero-speed relation between the ID surface 142 and the exemplary features 130, 131. FIG. 5 shows the outer lobes having flexed partially outward due to centrifugal action at a first car-downward speed. The inner lobes are shown as not having flexed due to greater rigidity. In practice, some flex will occur but may be smaller than that of the outer lobes. As is discussed below, at this speed, the outward flex of the outer lobes may be sufficient to trip a switch to shut the elevator down (e.g., interrupt power to the lift machine and engage the machine brake).

FIG. 2 further shows a rotor constraining ring 150 having an inner diameter (ID) surface 152. As with the ring 140, the constraining ring 150 may be generally formed having a radial web and a ring or collar portion protruding axially from a periphery of the web to provide the ID surface. The constraining ring 150 has a retracted or disengaged position and an extended or deployed or engaged condition (shown in broken lines). In the deployed condition, the ring 150 is positioned to potentially cooperate with the rotor. In this example, at a given speed, the rotor periphery 114 will expand into contact with the ID surface 152. As is discussed further below, the retraction or deployment of the constraining ring may be used to create different responses for different elevator operating conditions. For example, one operating condition may be upward movement whereas the other operating condition may be downward movement. In the exemplary system, the car-downward operational condition corresponds to the retracted constraining ring 150 and the car-upward operational condition corresponds to the extended condition. An actuator 154 may be provided to shift the constraining ring. An exemplary actuator is under control of the system controller 400 (FIG. 1). An exemplary actuator is a solenoid actuator shifting the constraining ring against a spring bias. In an exemplary implementation, the de-energized solenoid condition corresponds to the retracted condition of the constraining ring. In the exemplary implementation, with the constraining ring retracted, both sets of lobes may be driven outward and come into play in terms of controlling motion of the elevator. In the deployed condition, the constraining ring blocks outward movement of one of the sets of lobes. In the illustrated embodiment, a constraining ring blocks movement of the outer lobes by engaging their periphery 114 when the speed exceeds a given threshold. The particular threshold may depend on direction of governor rotation (and thus on direction of elevator movement). In some implementations, both the deployed and retracted conditions may be applied to both directions of movement. In other implementations, the deployed condition is applied only to one of the two directions.

In other embodiments, the constraining ring may interact not with the periphery but with axially protruding features similar to the features 130, 131 and may potentially interact with features mounted to the inner lobes rather than the outer lobes.

FIG. 2 shows the restraining ring 150 as carrying one or more switches 220. This provides the electric safety discussed above. The illustrated single switch has a pair of actuating levers 224 and 226. The exemplary lever 224 is positioned so that with the restraining ring retracted the lever can cooperate with the outer lobes. In the exemplary embodiment, distal end of the lever 224 may be engaged by the periphery 114 so as to be contacted at a threshold speed (e.g., the FIG. 5 speed) to trip the switch. Alternatives to a mechanical switch 220 including proximity sensors (e.g., Hall effect).

Figure 6:
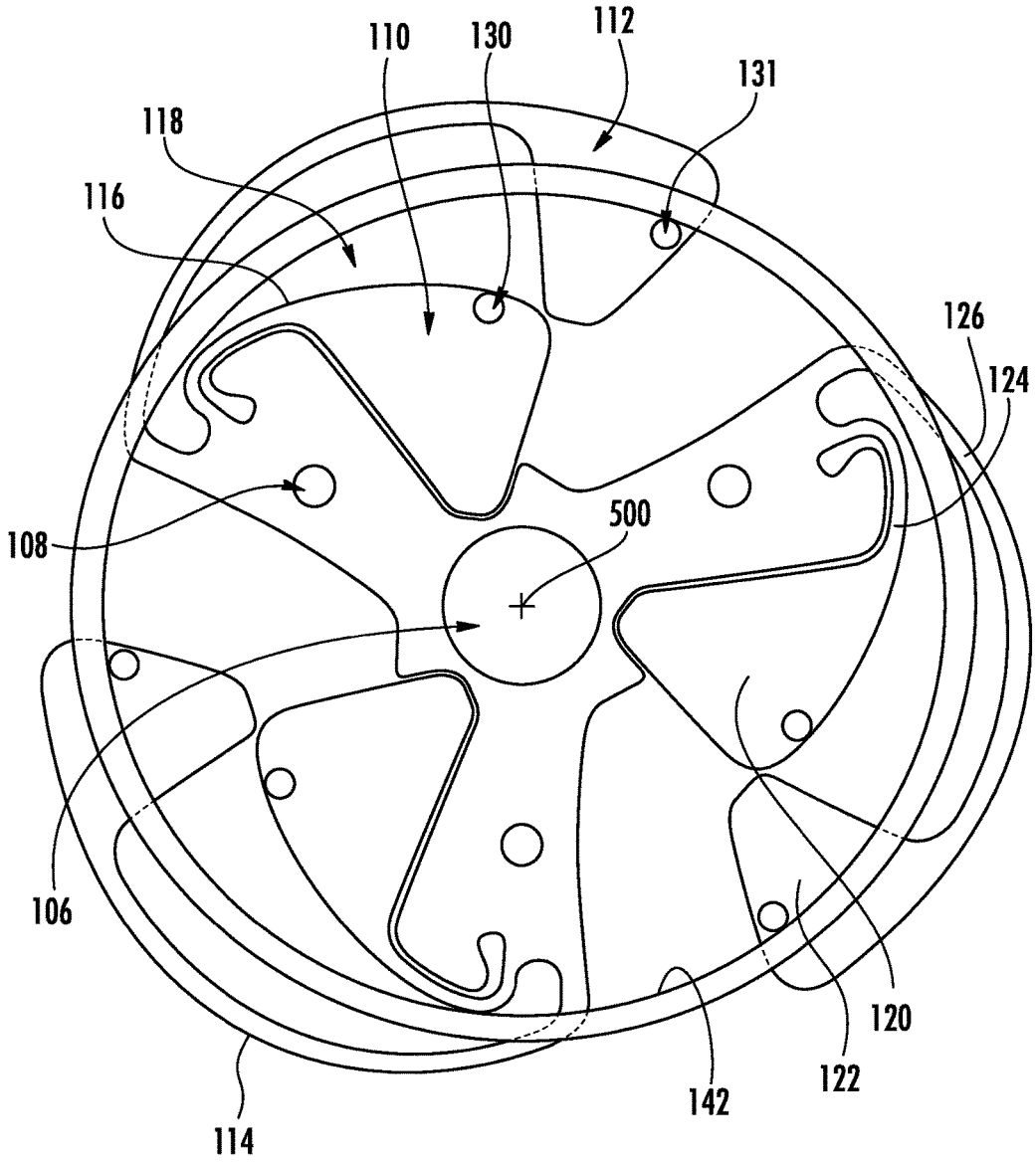
FIG. 6 is a partial view of the rotor showing lobe positions at a second car-downward speed.

As speed increases above that first threshold speed (e.g., due to a failure of the switch 220 to interrupt power and initiate braking), the outer lobes will continue to flex radially outward under centrifugal loading. Upon reaching a second threshold speed, the features 131 will eventually engage the ID surface 142 (FIG. 6). At that point, friction between the features 131 and the ring 140 will transmit rotation to the ring to, via a governor jaw system ("rope gripping system" or"jaw box" for applying frictional resistance to the governor rope) 160 and the linkage 80, 54, actuate the mechanical safeties 50.

Figure 1B:
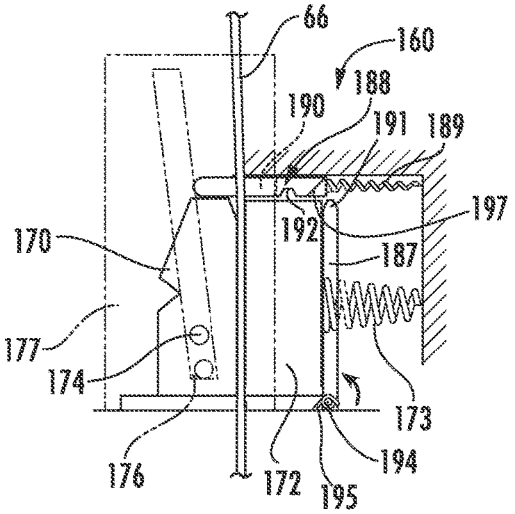
FIG. 1B is a further enlarged view of the governor rope clamp showing an engaged condition.

FIG. 1A further shows the governor jaw system 160 for applying tension to the rope 66 for actuating the linkage 80, 54 and safeties 50. The system 160 includes a linkage 162 cooperating with the ring 140. FIG. 1A shows a first end of the linkage received in a recess 146 in the outer diameter (OD) surface of the ring 140. When the ring 140 begins to rotate, the cooperation of the ring and the linkage actuates the governor jaw system. The linkage 162 provides an engagement mechanism positioned to be triggered by rotation of the rotor at a threshold speed to shift the governor rope gripping system from the ready condition (FIG. 1A) to the engaged condition (FIG. 1B).

The exemplary braking system 160 comprises a pair of jaws 170 and 172 held in proximity to the rope 66. The exemplary jaw 170 is held disengaged from the rope such as via pins 174 in a track and the linkage 162. For example, the jaw 170 may be normally held in a raised position by linkage 162. Tripping of the linkage 162 by the rotor lobes and rotation of the ring 140 may disengage a pawl 180 of the linkage 162 from the jaw 170. This allows the jaw 170 to drop (guided by pins 174 and track 176). In the exemplary embodiment there may be a pair of such tracks in respective plates 177 on opposite sides of the jaw 170. The dropping jaw then engages the rope (e.g., compressing the rope between the jaws 170 and 172) to impart friction on further movement of the rope so as to trip the actuator 80 as is discussed above. The exemplary jaw 172 is a quasi-fixed jaw backed by a spring for a slight range of motion. When the jaw 170 drops to its deployed position, it essentially becomes a fixed jaw with the jaw 172 being held biased by its spring to clamp the rope between the jaws with an essentially fixed force. Alternatives to the pins 174 and track include pivoting or other linkage mounting of the jaw 170.

In the exemplary embodiment, the jaw 172 is normally held retracted away from the rope such as via a stop (not shown acting against bias of the spring 173). The dropping of the jaw 170 pushes the rope against the jaw 172 (e.g., pushing the jaw 172 slightly back from its stop) so that the spring 173 creates spring-biased engagement clamping of the governor rope between the jaws and applying an essentially constant compressive force to the rope.

This compressive force results in application of friction to the moving rope 66. The friction is reacted by the actuator 80 as force above the threshold rope tension to, in turn, actuate the safeties 50.

A spring-loaded restraining plate 188 is also held retracted away from the rope (e.g. between the jaw 172 and fixed structure thereabove). When extended/deployed, the restraining plate restrains upward movement of the jaw 170 from the dropped position (e.g., when the rope is moving upward and friction acts upwardly on the jaws).

To extend the exemplary restraining plate, the actuation of the jaw 170 causes a linkage 187 to release the restraining plate to extend toward the rope driven by its spring 189. The exemplary linkage comprises a lever with an end portion 191 received in a shallow recess 192 in an underside of the restraining plate 188. A portion of the lever opposite a pivot 194 (defining a pivot axis) may be acted on by the falling jaw 170 to shift the end portion enough to allow bias of the spring to disengage the recess 192 from the end portion and shift the restraining plate to its deployed/extended condition. The exemplary restraining plate 188 has a vertically open U-shaped channel 190 that receives the rope to allow the underside of the plate aside the channel to pass above the upper end of the jaw 170 to block upward movement of the jaw. By restraining upward movement of the jaw 170, the restraining plate 188 facilitates improved bidirectional behavior of the governor jaw system. In particular, friction from upward rope movement will not be able to disengage the jaw 170. This may allow the governor jaw system 160 to replace two separate systems actuated for the respective up and down directions and placed on opposite sides of the governor rope loop.

A torsion spring 195 (e.g., at the pivot) may bias the linkage so as to, in turn, bias the restraining plate toward the retracted condition (overcoming the bias of the spring 189) when the projection is in the recess. The inertia of the falling jaw as it reaches the bottom of its range of motion can easily overcome the bias of the spring 195. In order to reset, the rear/proximal surface of the restraining plate has an angled camming surface 197 that can cooperate with the end portion 191 when the restraining plate is manually or automatedly retracted. This camming interaction allows the end portion to pass below the restraining plate and be received back in the recess 192.

Figure 7:
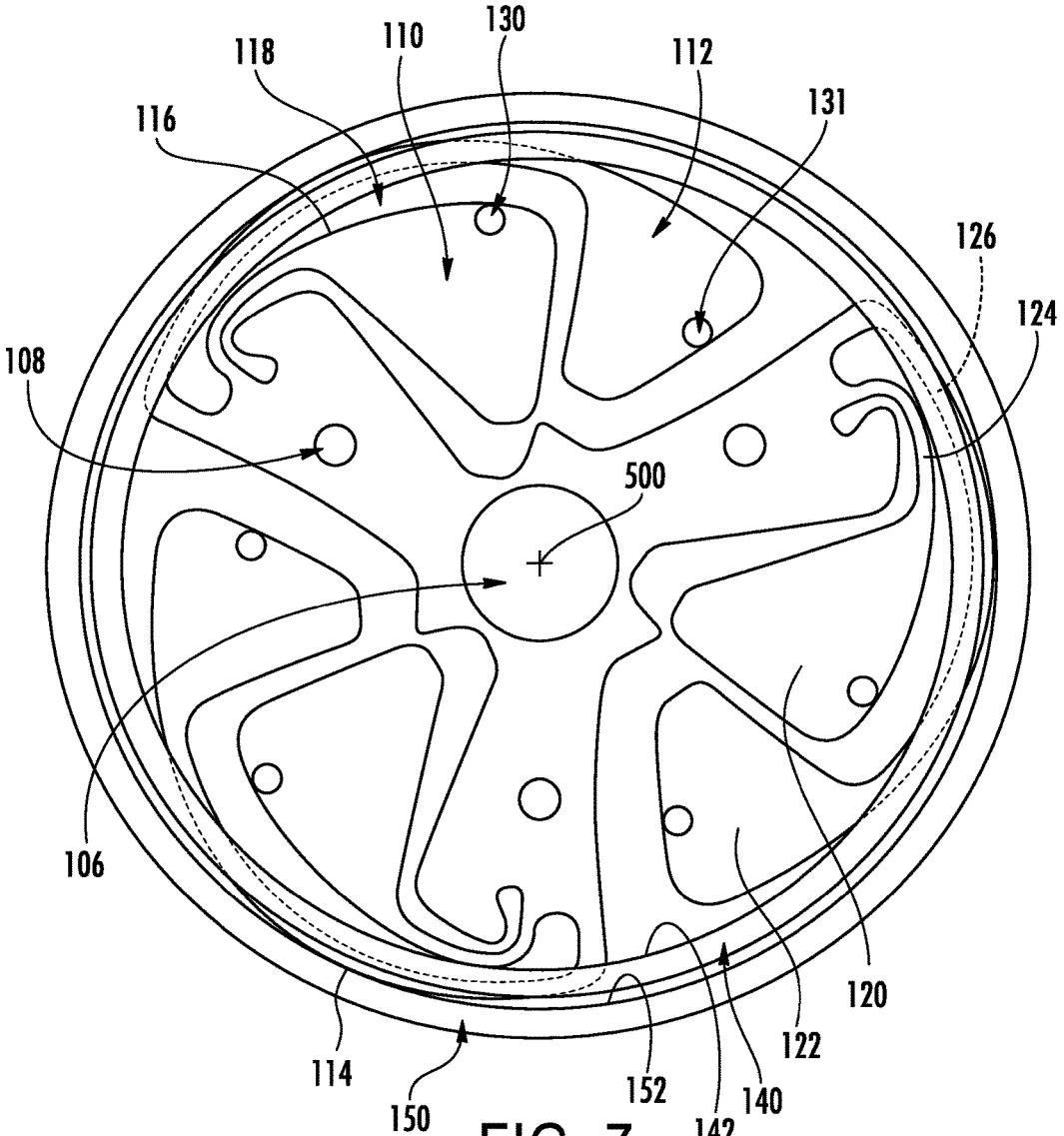
FIG. 7 is a partial view of the rotor showing lobe positions at a first car-upward speed.

In order to have different magnitudes of threshold speeds for the car-upward movement vs. the car-downward movement, the restraining ring 150 may be extended to the FIG. 2 broken line position. The features 130 of the inner lobes, rather than the features 131 of the outer lobes are used to trigger the mechanical brake or safety in this exemplary car-upward mode. To facilitate this, the extended/deployed restraining ring 150 restrains outward movement of the outer lobes. FIG. 7 shows the Periphery 114 having come into contact with the ID surface 152 before either of the sets of features 130 and 131 have come into engagement with the ID surface 142 of the ring 140. With increased speed, the ring 150 will prevent further outward radial movement of the outer lobes. The ID surface 152 may bear a low-friction coating or may be formed by a bearing to allow the rotor to rotate while engaging the ID surface 152.

Figure 8:
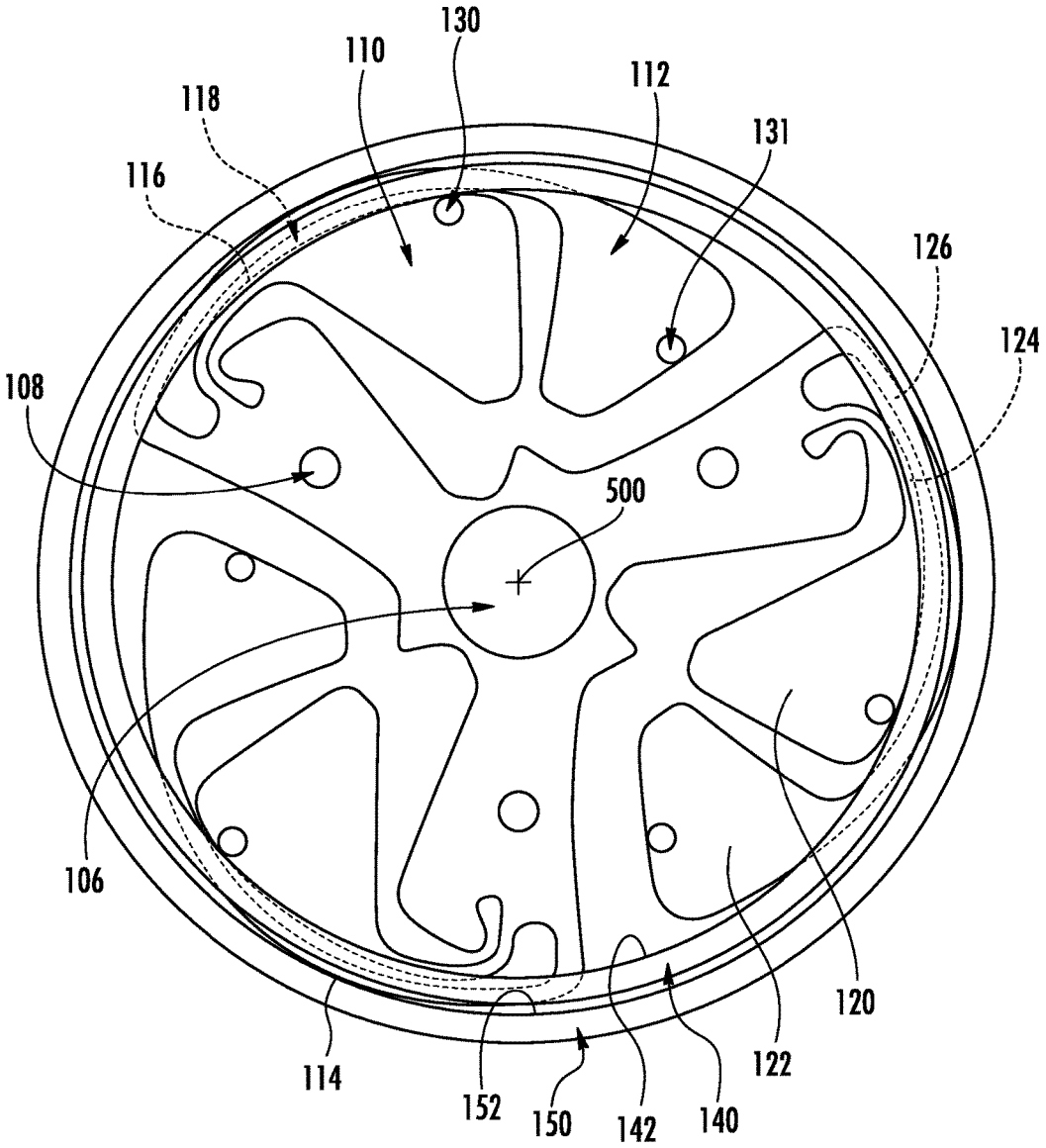
FIG. 8 is a partial view of the rotor showing lobe positions at a second car-upward speed.

FIG. 8 shows a greater car-upward speed where the features 130 have reached the ID surface 142 of the ring 140 to trigger the mechanical brake in similar fashion to the car-downward movement.

As with the car-downward mode, an electrical or electronic safety may be configured to trip in the car-upward mode at a lower threshold speed than the mechanical safety.

In the exemplary system, the extended ring 150 blocks switch access to the periphery 114. The switch 220 has a second lever 226 positioned to cooperate with a second set of inner lobe features 228 (e.g., an arc-shaped strip along the inner lobe peripheries on an opposite side from the features 130). This strip 228 may be limited in extent to the portion of the lobe periphery which will be most radially outboard near the desired speed for it to trip the switch 220 via the second lever 226 or otherwise trigger a switch, sensor, or the like.

The radial displacement behavior of the outer lobes vs. the inner lobes may be tailored to use the displacement of the two for different governor-related functions. An example below relates to differences in brake and safety engagement speeds in the car-upward direction versus the car-downward direction. However, lobe displacement may be used to address other issues requiring speed feedback. One example of such issues is to provide different parameters of stopping based upon initial car speed below the associated safety thresholds. This may involve improved comfort performance in addition to or alternatively to safety performance.

In a traditional flyweight governor, the safety threshold speed for car-upward movement may be the same or very close to the same as that for car-downward movement. Differences may result from slight asymmetries. For example, circumferential asymmetries in the location of the flyweight pivot relative to the flyweight center of mass may produce small asymmetries in the centrifugal displacement of the flyweight in the two different rotational directions. Similar asymmetries may exist with the lobes of a unitary rotor. However, the asymmetry alone may be insufficient to provide a desired difference in car-upward versus car-downward performance For example, it may be desired to configure the governor to have a higher car-upward threshold speed than car-downward. Such a difference may result from different human body response/comfort considerations in the two directions. For example, one embodiment may have car-upward thresholds of at least 20% greater than the associated car-downward thresholds or at least 30%. The use of the different sets of lobes in a single rotor may allow achievement of such asymmetry.

Figure 9:
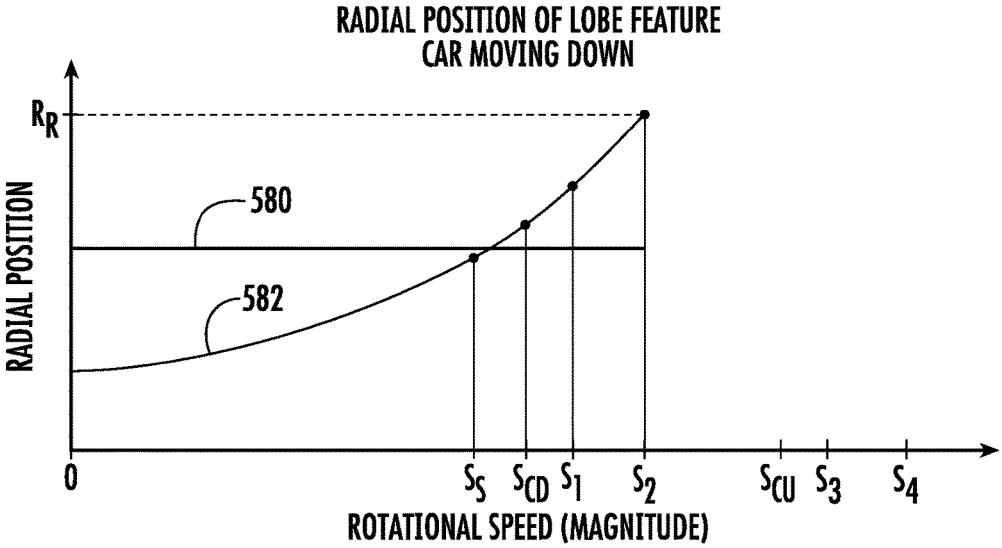
FIG. 9 is a simplified plot of rotor lobe radial position with car-downward speed.
Figure 10:
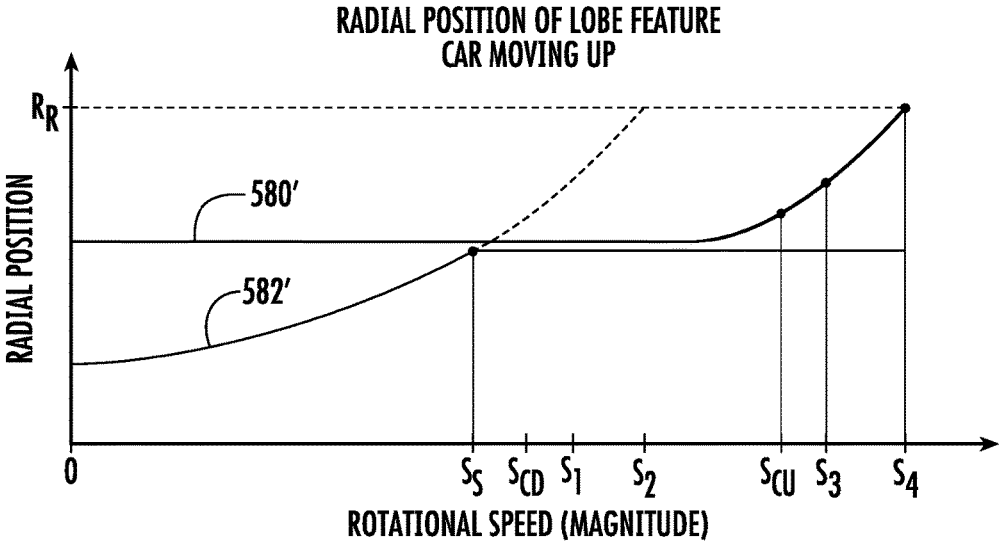
FIG. 10 is a simplified plot of rotor lobe radial position with car-upward speed.

FIGS. 9 and 10 show exemplary plots of rotor lobe displacement versus speed magnitude for the respective car-downward direction and car-upward direction. Due to fixed geometries, linear car speed is proportional to rotor rotational speed. Thus, either may be a proxy for the other. Plot 580 of FIG. 9 represents the inner lobe radial position and plot 582 represents the outer lobe radial position. These may be measured, for example, based upon the outboard-most extreme of the associated projections 130 and 131. FIG. 10 shows respective car-downward plots 580' and 582' similarly measured. The elevator may have a car-upward contract speed $S_{CU}$ and a car-downward contract speed $S_{CD}$. As alluded to above, $S_{CU}$ may be greater than $S_{CD}$ (e.g., by at least 10% or at least 20% or at least 30% or an exemplary 20% to 100% with alternative upper limits of 80% or 150% with any of such lower limits). Threshold speeds (for interrupting power, actuating the machine brake(s), and actuating the mechanical safeties) may be selected slightly above these values. For example, FIG. 9 shows a threshold speed $S_1$ where the switch or sensor 220 causes safety logic to interrupt power to the lift machine 32 and engage or "drop" the machine brake 44. $S_2$ identifies the slightly higher speed at which the safeties 50 are actuated via the actuator 80 (i.e., when the outer lobe features 131 reach the radius $R_R$ of the ring 140 surface 142). Similarly, $S_3$ identifies a car-upward threshold speed for power interruption to the lift machine and dropping of the machine brake. $S_4$ identifies the second car-upward threshold speed for actuation of the safeties 50 via the actuator 80. $S_3$ and $S_4$ may respectively represent similar increases over $S_1$ and $S_2$, respectively as $S_{CU}$ represents over $S_{CD}$. For purposes of non-limiting illustration, one exemplary $S_{CD}$ is 12 m/s. A corresponding $S_{CU}$ might be 18 m/s. For this, $S_1$ might be about 13 m/s and $S_2$ might be about 14 m/s to 15 m/s. $S_3$ might be about 19 m/s and $S_4$ might be about 22 m/s.

In the exemplary FIG. 9 embodiment, the inner lobe radial position plot 580 is shown as relatively insensitive to speed compared with the outer lobe radial position plot 582. Although shown as a horizontal line, in practice the plot 580 would be expected to have a slight upward slope. The properties of the inner lobes versus the outer lobes, including their relative deformability, the nature of the radial gap between them and the relative positions of the projections are chosen so that in the critical speed range outer lobes (or their relevant features) are at greater radial position.

FIG. 10 shows that in order to have the inner lobes be at the relevant radial positions in the relevant speed range, the outer lobe plot 582' is stopped from radially diverging by engagement with the ring 150 at a speed $S_S$. To achieve this, the ring 150 is extended at a time before the car-upward speed reaches $S_S$. The ring 150 inner radius is selected to that $S_S$ occurs before $S_1$. $S_S$ may occur slightly before $S_1$, however, for purposes of illustration a larger speed gap and thus time delay is shown.

In some embodiments, the extension of the ring 150 may be exactly upon switching to car-upward operation. In others, it may be only after reaching a certain threshold speed lower than $S_S$. This delay may reduce cycling for short elevator trips where speed never approaches the contract speed. With the ring 150 constraining outer lobe movement at speeds above $S_S$, the inner ring may become operative in the critical speed range approaching $S_4$. Again, FIG. 10 shows a lower speed portion of the plot 580' as essentially having lobes at a constant radial position. However, this may, instead, merely be a lower speed continuation of the increasing displacement curve. FIG. 10 also shows a broken line continuation of the plot 582' showing what would have been the characteristic radial position of the outer lobes in the absence of engagement of the ring 150.

FIG. 1 further shows a controller 400. The controller may receive user inputs from an input device (e.g., switches, keyboard, or the like) and sensors (not shown, e.g., position and condition sensors at various system locations). The controller may be coupled to the sensors and controllable system components (via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

The elevator system may be made using otherwise conventional or yet-developed materials and techniques. The rotor may be manufactured by a number of methods including stamping or laser or water jet machining from a spring steel blank.

A similar rotor may be used as a portion of a car-mounted governor (not shown). Various other conventional or yet-developed governor features may be included. For example, features may be provided for manually or automatically resetting various elements including the governor jaw system jaws 170 and 172, the linkages for actuating them, the safeties, and the linkages for actuating them.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic elevator system or governor system, details of such configuration or its associated use may influence details of particular implementations. Accordingly, other embodiments are within the scope of the following claims.

What is claimed is:

1. An elevator governor rotor comprising:
a central axis; and
a plurality of pairs of lobes, each pair of lobes comprising: an inner lobe and an outer lobe,
wherein:
each of the inner lobes and outer lobes comprises:
a distal protuberant portion; and
a generally circumferentially extending radially outboard flexing portion; and
in a zero-speed condition, the inner lobes are nested between the protuberant portion and flexing portion of the associated outer lobe.

2. The rotor of claim 1 wherein:
each inner lobe is between the central axis and the associated outer lobe.

3. The rotor of claim 1 wherein:
a single piece forms the plurality of pairs of lobes.

4. The rotor of claim 1 wherein the flexing portion of each of the inner lobes and outer lobes is configured to centrifugally flex as the rotor rotates about its central axis and the respective associated protuberant portion radially outwardly displaces.

5. The rotor of claim 1 further comprising:
axial projections projecting axially from the at least one of the inner lobes and the outer lobes.

6. An elevator governor comprising:
the rotor of claim 1;
a sheave mounted for rotation about the axis; and
a sensor positioned to interface with the rotor in at least a portion of a speed range of the rotation.

7. The governor of claim 6 wherein each of the inner lobes has an axial projection and each of the outer lobes has an axial projection and the governor further comprises:
an actuating ring positioned to be engaged by:
said axial projections of the inner lobes in at least one condition of centrifugal radial displacement of said axial projections of the inner lobes; and
said axial projections of the outer lobes in at least one condition of centrifugal radial displacement of said axial projections of the outer lobes.

8. The governor of claim 7 wherein the sensor is positioned to engage the periphery at a threshold speed in at least a first condition and the governor further comprises:
a restraining ring shiftable between a first position in the first condition and a second position in a second condition; and
an actuator coupled to the restraining ring to shift the restraining ring.

9. The governor of claim 8 further comprising a controller having programming to:
shift the restraining ring from the first condition to the second condition with a change in elevator direction.

10. The governor of claim 7 wherein:
at a first rotational speed about the axis, movement of the outer lobes triggers the sensor; and
at second rotational speed about the axis, greater than the first rotational speed, the axial projection of the outer lobes engage the actuating ring to, in turn, engage a mechanical safety.

11. An elevator comprising the governor of claim 6 further comprising:
a car mounted in a hoistway for vertical movement;
an elevator machine coupled to the car to vertically move the car within the hoistway; and
a rope engaging the sheave to rotate the rotor as the car moves vertically.

12. The elevator of claim 11 wherein:
the sheave is mounted relative to the hoistway for said rotation about said axis.

13. The elevator of claim 11 further comprising:
a mechanical safety and a safety linkage for actuating the mechanical safety, the rope being coupled to the safety linkage;
a governor rope gripping system having a ready condition disengaged from the rope and an engaged condition clamping the rope to impose a drag on the rope as the rope moves; and
an engagement mechanism positioned to be triggered by rotation of the rotor at a threshold speed to shift the governor rope gripping system from the ready condition to the engaged condition.

14. The elevator of claim 11 wherein:
the elevator machine has a brake electrically or electronically coupled to the sensor.

15. The elevator of claim 11 to wherein:
the inner lobes are configured to be operative to govern elevator speed in a first direction of up and down and the outer lobes are configured to govern elevator speed in the other direction.

16. A method for using the elevator of claim 1, the method comprising:
shifting the restraining ring in association with a change in direction of the elevator.

17. The method of claim 16 wherein:
the governor is configured to allow a higher car-upward speed than car-downward speed.

18. The method of claim 16 wherein:
the governor is configured to allow a maximum car-upward speed at least 20% higher than a maximum car-downward speed.

19. The method of claim 16 wherein:
a mechanical safety actuating action of the governor is configured to allow a maximum car-upward speed at least 20% higher than a maximum car-downward speed.

20. An elevator governor jaw system comprising:
a first jaw shiftable from a disengaged position to an engaged second position via a partially downward motion;
a second jaw spring biased toward the first jaw when the first jaw is in the engaged position so as to clamp the rope between the first jaw and the second jaw; and
means for restraining upward movement of the first jaw from the engaged position,
wherein:

the means comprises a restraining member shiftable from a retracted position to an extended position under bias of a spring; and a linkage is configured to hold the restraining member in its retracted condition until actuated by a dropping of the first jaw from the disengaged position to the engaged position so as to release the restraining member.

21. The elevator governor jaw system of claim 20 wherein:

a guide means is configured to guide the partially downward motion to bring the first jaw into contact with the rope.

22. The elevator governor jaw system of claim 21 wherein:

the guide means is configured to guide the partially downward motion to bring the first jaw into contact with the rope so as to, in turn, bring the rope into engagement with the second jaw.

23. A method for using an elevator, the elevator comprising:

a car mounted in a hoistway for vertical movement;

an elevator machine coupled to the car to vertically move the car within the hoistway;

an elevator governor configured to allow a higher car-upward speed than car-downward speed and comprising:

elevator governor rotor comprising:

a central axis; and a plurality of pairs of lobes, each pair of lobes comprising an inner lobe and an outer lobe a sheave mounted for rotation about the axis; and a sensor positioned to interface with the rotor in at least a portion of a speed range of the rotation; and a rope engaging the sheave to rotate the rotor as the car moves vertically the method comprising:

shifting the restraining ring in association with a change in direction of the elevator.

* * * * *